US006375583B1

(12) United States Patent
Solheim

(10) Patent No.: US 6,375,583 B1
(45) Date of Patent: Apr. 23, 2002

(54) GOLF PUTTER HEAD AND METHOD OF MAKING SAME

(75) Inventor: John K. Solheim, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 09/738,669

(22) Filed: Dec. 15, 2000

(51) Int. Cl.[7] ..... A63B 53/04

(52) U.S. Cl. ..... 473/329; 473/337; 473/341; 473/342

(58) Field of Search ..... 473/324, 329, 473/332, 334, 335, 336, 337, 340, 341, 349, 350, 342, 291; D21/736

(56) References Cited

U.S. PATENT DOCUMENTS

| | | | | |
|---|---|---|---|---|
| 2,781,197 | A | * | 2/1957 | Wiley |
| 4,508,350 | A | | 4/1985 | Duclos |
| 4,530,505 | A | | 7/1985 | Stuff |
| 4,655,459 | A | | 4/1987 | Antonious |
| 4,714,252 | A | | 12/1987 | Roraback |
| 4,872,683 | A | | 10/1989 | Doran et al. |
| 4,927,144 | A | | 5/1990 | Stormon |
| 4,979,744 | A | | 12/1990 | Alcala |
| 5,246,227 | A | | 9/1993 | Sun et al. |
| 5,332,214 | A | | 7/1994 | Tucker |
| 5,390,919 | A | | 2/1995 | Stubbs et al. |
| 5,575,472 | A | | 11/1996 | Magerman |
| 5,580,058 | A | | 12/1996 | Coughlin |
| 5,707,299 | A | | 1/1998 | McKenna |
| 5,839,974 | A | | 11/1998 | McAllister |
| 5,947,841 | A | | 9/1999 | Silvestro |
| 5,964,669 | A | | 10/1999 | Bloomer |

* cited by examiner

*Primary Examiner*—Sebastiano Passaniti
(74) *Attorney, Agent, or Firm*—Darrell F. Marquette

(57) ABSTRACT

A golf putter head includes a metal body with a heel, a toe and a front face. The metal body has a central cavity and a pair of lateral cavities in the front face with the lateral cavities being spaced apart and disposed at opposite ends of the central cavity. One of the lateral cavities is located adjacent the heel of the body, and the other lateral cavity is located adjacent the toe of the body. A blind bore formed in each lateral cavity extends into the body in a direction generally perpendicular to the front face. A weight member is disposed in each blind bore. Non-metallic material in the central and lateral cavities forms an insert in the central cavity arranged for impacting a golf ball and other inserts in the lateral cavities for retaining the weight members in the blind bores. Preferably, the non-metallic material in the central cavity and the lateral cavities is polyurethane. The front face of the body, including the inserts, is finished by using a milling machine to provide a flat surface extending between the heel and the toe of the body.

4 Claims, 4 Drawing Sheets

GOLF PUTTER HEAD AND METHOD OF MAKING SAME

BACKGROUND OF THE INVENTION

This invention relates generally to golf clubs and, in particular, to a golf putter head and a method of making a golf putter head.

Putting a golf ball is a highly individual skill with many types of putters used by golfers to suit their individual preferences. The feel and appearance of putters vary considerably and may affect a golfer's results when putting. Putter heads have progressed from a simple blade-shaped design to sophisticated designs which include special weight distribution to improve performance.

It is well known that weight distribution in a putter head affects the tendency of the putter head to rotate about its center of gravity when impacting a golf ball at locations spaced from the center of gravity. In order to reduce the tendency for such putter head rotation, weight is added in heel and toe portions of the putter head to increase the moment of inertia. In many instances, the desired heel-to-toe weight distribution is achieved by making the putter heads with enlarged mass concentrations in the heel and toe portions thereof Examples of putter heads which are made with such heel-to-toe weight distribution are disclosed in U.S. Pat. Nos. 5,226,654 and 5,292,128 to Karsten Solheim. In other instances, the desired heel-to-toe weight distribution is achieved by inserting separate weight members in the heel and toe portions of a putter head. U.S. Pat. No. 4,927,144 to R. Stormon discloses a putter head formed with a downwardly opening cavity and blind bores extending upwardly into heel and toe portions of the putter head. Weights are placed in the blind bores and retained by a plate secured by screws to close the downwardly opening cavity. U.S. Pat. No. 5,947,841 to C. Silvestro discloses a polyurethane putter head formed with rearwardly opening heel and toe chambers extending normally and rearwardly from the ball striking face. Weight members are placed in the heel and toe chambers, and plugs are held in these chambers by means of a suitable adhesive.

Traditionally, putter heads have been made entirely of metal but current trends include making putter heads with face inserts formed of materials which provide softer feel than metal. The usual method of making a putter head with a face insert is to form a metal head with a cavity in the ball striking face and then to fill that cavity with the desired insert. Two different methods have been used to affix the insert within the cavity. The first method is to form the insert as a separately molded piece and then use a suitable adhesive or mechanical fasteners to hold the insert in the cavity. The second method includes molding of the face insert within the cavity. After the insert has cured, the entire front face of the putter head including the insert is finished with a milling machine to provide a flat surface extending between the heel and toe portions of the putter head.

SUMMARY OF THE INVENTION

In one embodiment of the present invention, a golf putter head includes a body formed of metal having a heel, a toe and a front face. The body is formed with a pair of lateral cavities in the front face. The lateral cavities are spaced apart with one of the lateral cavities located adjacent the heel of the body, and the other lateral cavity located adjacent the toe of the body. The body has a pair of blind bores with one of the blind bores formed in each of the lateral cavities extending into the body in a direction generally perpendicular to the front face. The golf putter head also includes a pair of weight members with one weight member disposed in each of the blind bores. Non-metallic material is disposed in the lateral cavities in the body forming inserts in the lateral cavities for retaining the weight members in the blind bores. The body may also be formed with a central cavity in the front face. The lateral cavities are disposed at opposite ends of the central cavity. Further non-metallic material is disposed in the central cavity forming another insert in the central cavity arranged for impacting a golf ball. The non-metallic material in the central cavity and the lateral cavities may be polyurethane. The body of the golf putter head may also include partition walls separating the lateral cavities from the central cavity.

In another embodiment of the present invention, a golf putter head includes a body formed of metal having a heel, a toe and a front face. The body has an elongated cavity in the front face extending from the heel to the toe. A pair of blind bores is formed in the elongated cavity and extends into the body in a direction generally perpendicular to the front face. One of the blind bores is located adjacent the heel of the body and the other blind bore is located adjacent the toe of the body. The golf putter head further includes a pair of weight members with one weight member disposed in each of the pair of blind bores. Non-metallic material in the elongated cavity forms insert means in the elongated cavity arranged for striking a golf ball and for retaining the weight members in the blind bores.

The present invention further provides a method of making a golf putter head including the step of forming a body of metal with a heel, a toe, a front face with cavity means extending from proximate the heel to proximate the toe, and a pair of blind bores located adjacent opposite ends of the cavity means. The method also includes the steps of inserting one of a pair of weight members in each of the blind bores, filling the cavity means with non-metallic material to form insert means arranged for impacting a golf ball and to retain the weight members in the blind bores, and finishing the front face of the body including the insert means to provide a flat surface extending between the heel and the toe of the body. The cavity means provided in the forming step may comprise a central cavity, and a pair of lateral cavities located adjacent opposite ends of the central cavity and separated from the central cavity by partition walls. One of the blind bores will be formed in each of the lateral cavities.

DESCRIPTION OF THE PREFERRED EMBODIMENTS

Figure 1:
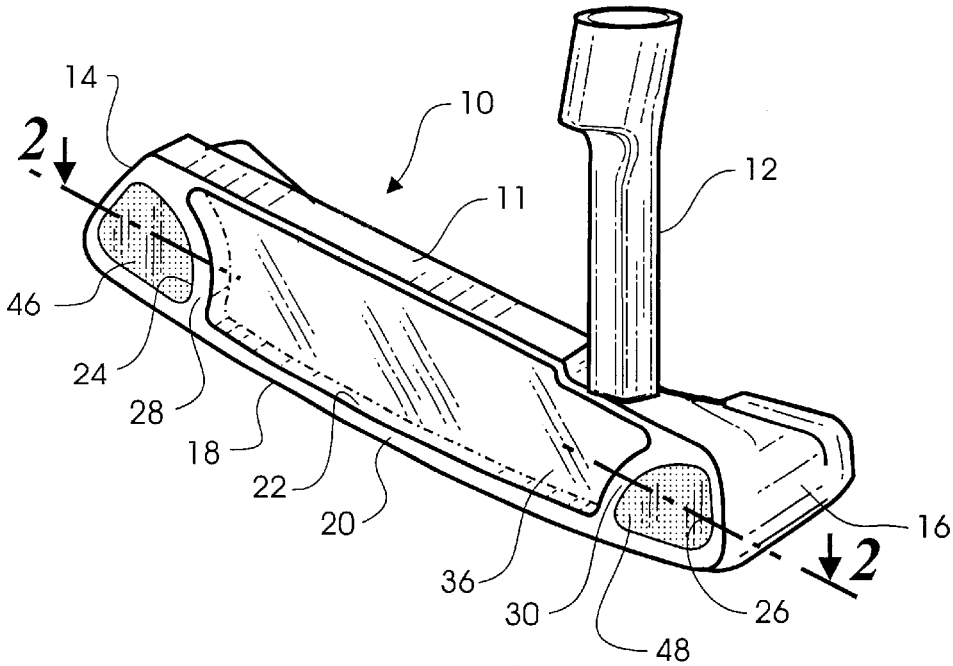
FIG. 1 is a perspective view of a putter head according to the present invention.
Figure 2:
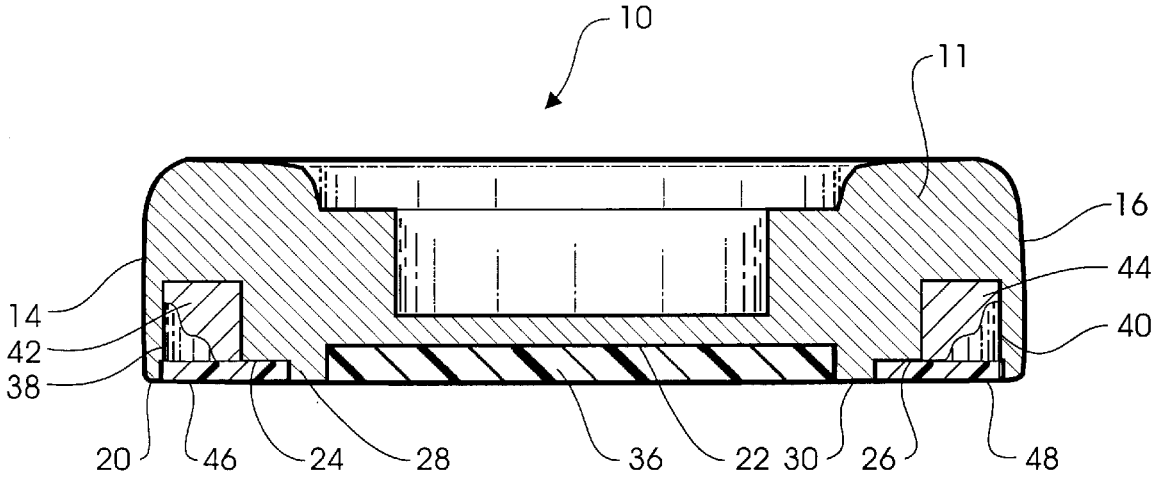
FIG. 2 is an enlarged sectional view taken along line 2—2 in FIG. 1.

Referring to the drawings, FIGS. 1 and 2 show one embodiment of a putter head according to the present invention which is indicated generally by the reference numeral 10. The putter head 10 includes a body 11 having a hosel 12 for receiving a shaft (not shown), a toe 14, a heel 16, a sole 18 and a front face 20 arranged for striking a golf ball.

The body 11 is formed of suitable metal such as stainless steel and is provided with a central cavity 22 in its front face 20 and a pair of lateral cavities 24, 26 also formed in the front face 20 which are spaced apart and located at opposite ends of the central cavity 22. The lateral cavity 24 is located adjacent the toe 14 of the body 11, and the lateral cavity 26 is located adjacent the heel 16 of the body 11. The central and lateral cavities 22, 24 and 26 extend into the front face 20 with the lateral cavity 24 being separated from the central cavity 22 by a partition wall 28 and the lateral cavity 26 being separated from the central cavity 22 by another partition wall 30.

An insert 36 formed of non-metallic material, such as polyurethane, is located in the central cavity 22 filling the cavity 22. A blind bore 38 is formed at the bottom of the lateral cavity 24, and a similar blind bore 40 is formed at the bottom of the lateral cavity 26. The blind bores 38, 40 extend into the body 11 in a direction generally perpendicular to the front face 20. Weight members 42 and 44 are disposed in the blind bores 38 and 40, respectively, with the weight members 42, 44 being formed of high density metal such as tungsten that is denser than the metal from which the body 11 is formed. The exact density of the weight members 42, 44 is determined by variables such as the desired total mass of the putter head 10 and the desired heel-to-toe weight distribution of the putter head 10. Non-metallic material, such as polyurethane, is also provided in the lateral cavities 24, 26 forming other inserts 46, 48 retaining the weight members 42, 44 in the blind bores 38, 40 and filling those cavities 24, 26 to thereby complete the front face 20.

Figure 3:
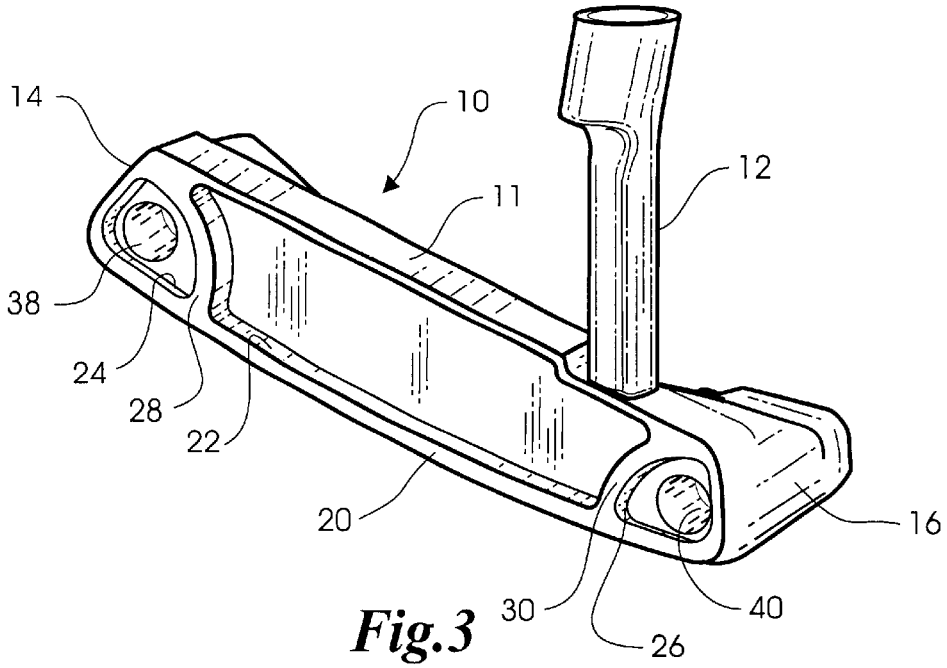
FIG. 3 is another perspective view of the putter head of FIG. 1 during one step of a method of making a putter head according to the present invention.
Figure 4:
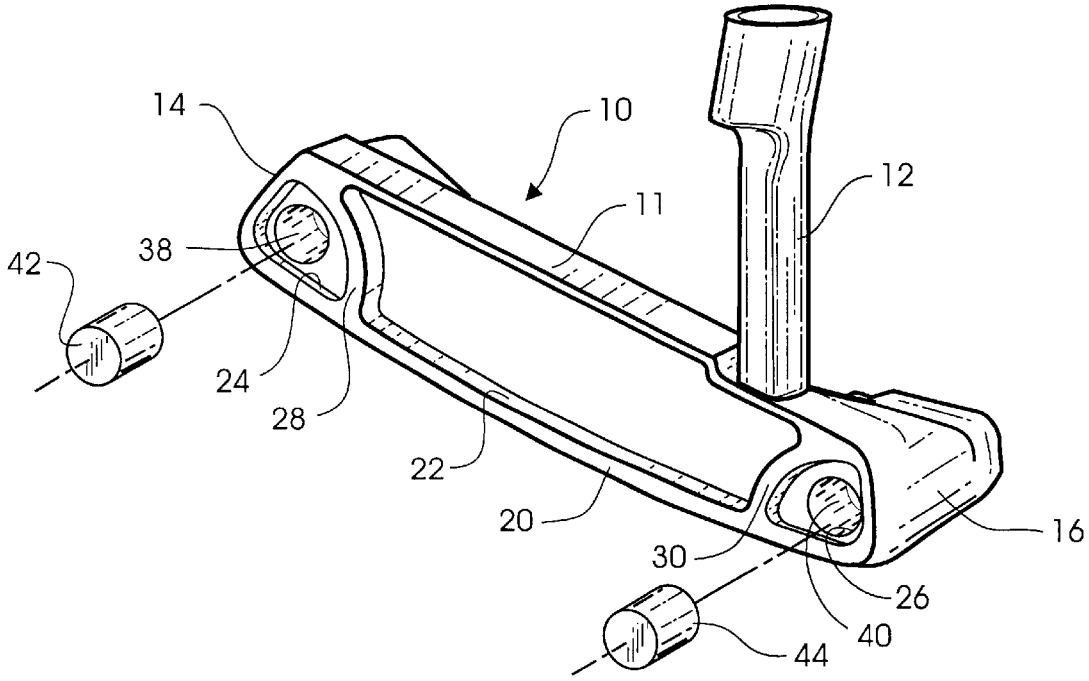
FIG. 4 is a perspective view similar to FIG. 3 illustrating other steps of the method of making a putter head.
Figure 5:
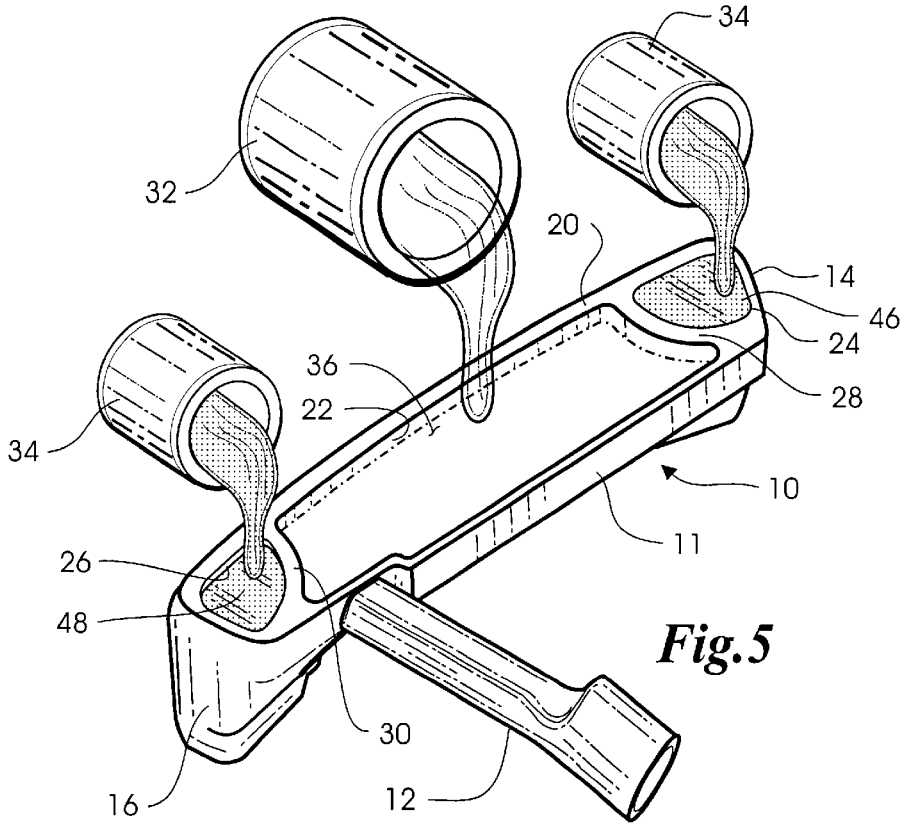
FIG. 5 is a perspective view of the putter head showing a further step of the method of making a putter head.
Figure 6:
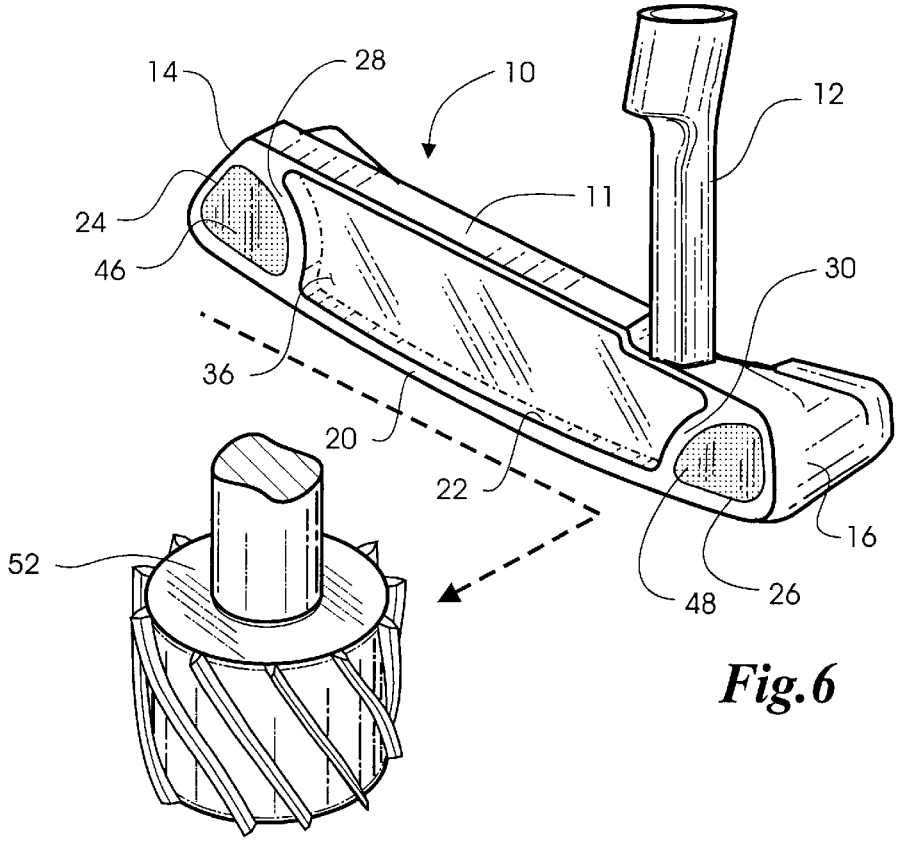
FIG. 6 is a perspective view showing another step of the method of making a putter head.

Reference is now made to FIGS. 3–6 wherein the various steps of the preferred method of making the putter head 10 are illustrated. FIG. 3 shows the step where the body 11 has been formed with the central cavity 22 and the lateral cavities 24, 26. The body 11 is also formed with the blind bores 38 and 40 at the bottoms of the lateral cavities 24 and 26, respectively. FIG. 4 shows the step of inserting the weight members 42, 44 into the blind bores 38, 40. FIG. 5 shows the steps of filling the central cavity 22 with polyurethane (in a liquid state) from a container 32 to form the insert 36, and the step of filling the lateral cavities 24, 26 with polyurethane (in a liquid state) from containers 34 to form the inserts 46, 48. The method step, subsequent to the steps of filling the central cavity 22 and the lateral cavities 24 and 26, is the curing of the polyurethane. The curing may be accomplished by simply allowing the polyurethane to harden at room temperature or, if more rapid curing is desirable, the putter head 10 may be heated. The final method step is finishing of the front face 20 including inserts 36, 46, 48 to provide a flat surface extending between the toe 14 and the heel 16. This finishing step can be accomplished by using a conventional milling machine 52.

The insert 36 may be formed of other non-metallic material and is not limited to being formed of polyurethane. As to the non-metallic material used to form the inserts 46, 48, polyurethane is preferred but it will be understood that epoxy may also be used in forming the inserts 46, 48.

Figure 7:
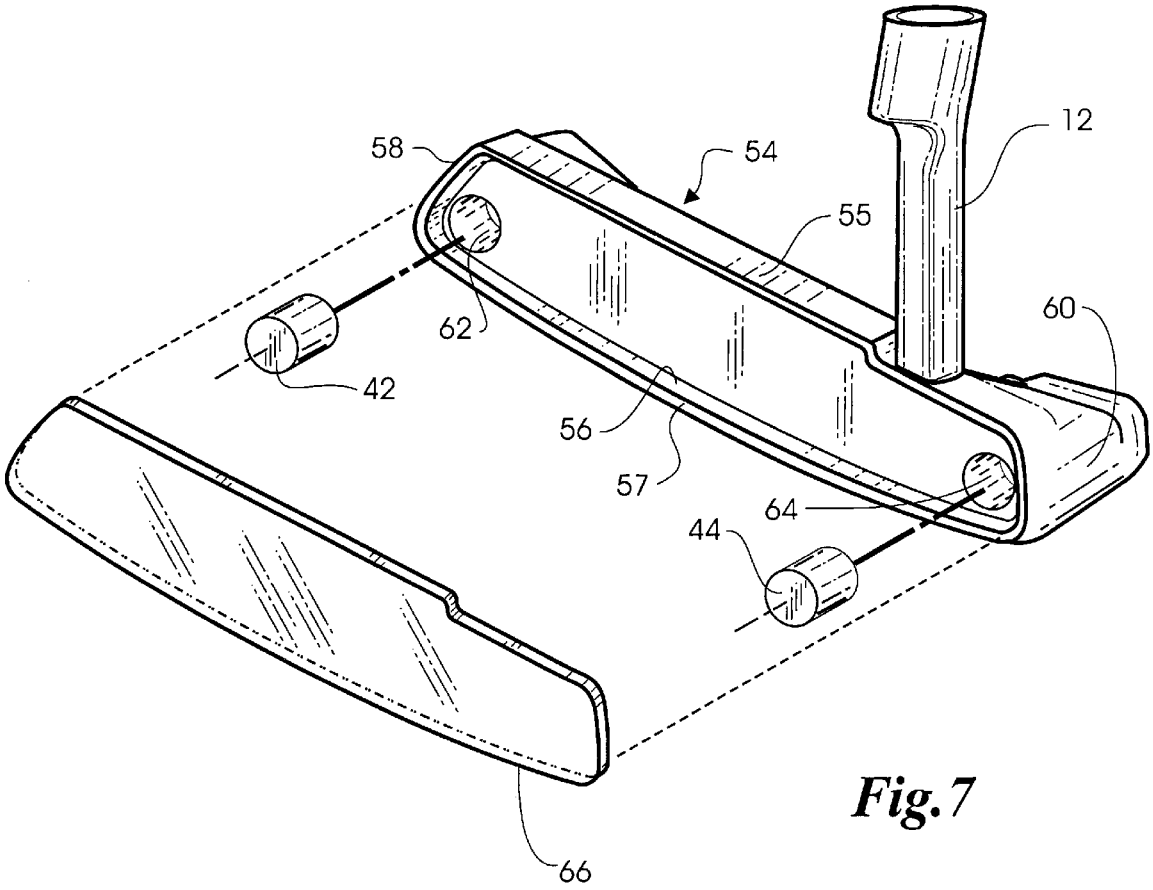
FIG. 7 is an exploded perspective view illustrating another embodiment of a putter head and another method according to the present invention.

Referring to FIG. 7, a putter head 54 according to another embodiment of the present invention is shown. Instead of the central cavity 22 and the lateral cavities 24, 26 in the body 11 of the putter head 10, the putter head 54 is formed with a single elongated cavity 56 which extends from a toe 58 to a heel 60 in a front face 57 of a body 55. A pair of blind bores 62, 64 are provided in the bottom of the cavity 56 at opposite ends of the cavity 56. The blind bores 62, 64 extend into the body 55 in a direction generally perpendicular to the front face 57. The blind bore 62 is located adjacent the toe 58, and the blind bore 64 is located adjacent the heel 60. It is understood that the blind bores 62, 64 receive the weight members 42, 44 as discussed above to thereby provide the putter head 54 with the desired heel-to-toe weight distribution. The putter head 54 is completed by an insert 66 which is cast and cured within the cavity 56. The front face 57 of the body 55 is machined to provide a flat surface extending between the heel 58 and the toe 60.

What is claimed is:

1. A golf putter head comprising:

a body formed of metal having a heel, a toe, and a front face;

said body being formed with a pair of lateral cavities in said front face, said pair of lateral cavities being spaced apart with one of said lateral cavities located adjacent the heel of said body and the other one of said lateral cavities located adjacent the toe of said body, said body also having a pair of blind bores with one of said blind bores formed in each of the lateral cavities and extending into said body in a direction generally perpendicular to said front face;

a pair of weight members with one of said weight members disposed in each of said blind bores;

non-metallic material in said cavities forming inserts which fill said lateral cavities and retain said weight members in said blind bores;

said body also being formed with an elongated central cavity, which is devoid of weight members, in said front face with said pair of lateral cavities disposed at opposite ends of said central cavity; and further non-metallic material in said central cavity forming another insert which fills said central cavity and is arranged for impacting a golf ball.

2. The golf putter head of claim 1, wherein said non-metallic material is polyurethane.

3. The golf putter head of claim 1, wherein said further non-metallic material is polyurethane.

4. The golf putter head of claim 1, wherein said body further comprises partition walls separating said lateral cavities from said central cavity.

* * * * *